United States Patent [19]

Rathert

[11] 4,383,683

[45] May 17, 1983

[54] APPARATUS FOR SEPARATING THE BOTTOM SHEET OF A STACK OR SHEETS

[75] Inventor: Horst Rathert, Minden, Fed. Rep. of Germany

[73] Assignee: Rahdener Maschinenfabrik August Kolbus, Rahden, Fed. Rep. of Germany

[21] Appl. No.: 190,415

[22] Filed: Sep. 24, 1980

[30] Foreign Application Priority Data

Oct. 6, 1979 [DE] Fed. Rep. of Germany ..... 2940669

[51] Int. Cl.[3] ..... B65H 39/043; B65H 3/08; B65H 3/50

[52] U.S. Cl. ..... 270/58; 270/54; 271/101; 271/106; 271/113; 271/263

[58] Field of Search ..... 271/101, 100, 99, 102, 271/113, 97, 106, 9, 263, 262; 270/58, 54

[56] References Cited

U.S. PATENT DOCUMENTS

| | | | |
|---|---|---|---|
| 1,945,248 | 1/1934 | Winkler et al. | 271/101 X |
| 2,142,143 | 1/1939 | Novick | 271/113 X |
| 2,722,414 | 11/1955 | Smith | 270/58 |
| 2,815,948 | 12/1957 | Watter | 271/97 UX |
| 2,817,520 | 12/1957 | Gentry | 271/101 |
| 3,055,658 | 9/1962 | Kister | 271/101 |
| 3,652,084 | 3/1972 | Eberle | 271/113 |
| 3,744,787 | 7/1973 | Morrison | 271/263 X |
| 3,926,427 | 12/1975 | Moksnes et al. | 271/99 X |

FOREIGN PATENT DOCUMENTS

| | | | |
|---|---|---|---|
| 708306 | 5/1954 | United Kingdom | 271/102 |

OTHER PUBLICATIONS

Griesemer, J. A. et al., "Lifting Ceramic Green Sheets," *IBM Tech. Disc. Bull.,* vol. 14, No. 11, Apr. 1972, p. 3342.

*Primary Examiner*—Bruce H. Stoner, Jr.

[57] ABSTRACT

An apparatus for separating the bottom sheet of a stack of sheets contained in a stationary magazine. A rotating disc supports substantially the entire bottom surface of a stack of sheets contained in a sheet stack magazine disposed above the disc, the corner of the magazine pointing oppositely to the direction of rotation of the disc. The latter has a recess (17,18) extending radially from its periphery and also another recess (20,21) extending in the direction of rotation from the first-mentioned recess and covering an angle of rotation of about 90°. A suction element (19) is adapted to be moved through the recess to the corner of the stack of sheets and in synchronism with the rotating recesses grips the corner of the bottom sheet, tips it over, and transports it to a table under the disc. A clamp lever takes over the corner of the sheet, which has been tipped over from the stack of sheets, before it is released by the suction element and holds it on the table during the peeling-off operation.

15 Claims, 8 Drawing Figures

APPARATUS FOR SEPARATING THE BOTTOM SHEET OF A STACK OR SHEETS

BACKGROUND OF THE INVENTION

1. Field of the Invention

The invention relates to an apparatus for separating the bottom sheet from a stack of sheets which are contained in a stationary magazine. The apparatus comprises a rotating disc which supports the stack and has a recess open towards its periphery. A suction element, adapted to travel through the recess and under the stack of sheets, grips and pulls the edge of the bottom sheet under the disc. The bottom sheet is then placed upon a table which is disposed under the disc. This operation is continued until all the sheets have been separated.

2. Description of the Prior Art

U.S. Pat. No. 3,045,8676 discloses an apparatus for separating elastic plates from a stack. These elastic plates are held in position upon a rotating disc in a rectangularly aligned position. Because of the inherent rigidity of the elastic plates and also because of an opposing force applied from above against the stack of plates, the stack is supported only by up to half of its bottom surface while the bottom plate is gripped. However, the above disclosed apparatus is limited for the use with elastic plates and cannot be used for the separation of labile paper products, for example of book sections or single sheets.

Moreover, the delivery of book sections or single sheets at rates of 10,000 or more per hours, which is required by present standards, cannot be achieved by the apparatus disclosed by the above-mentioned U.S. patent. This limitation of delivery speed is due to the rectilinear movement cycle and the consequent inertia of the suction element. Since the suction element grips the elastic plates at the periphery of the rotating disc, the use of the apparatus of the above-mentioned patent is limited with respect to the size of the products to be separated.

SUMMARY OF THE PRESENT INVENTION

The present invention overcomes the above-mentioned deficiencies of the prior art by providing a separating apparatus which is suitable for separating all kinds of sheet-like, flexible products, particularly labile book sections, at high speed and with operational reliability.

According to the present invention the separating apparatus is provided with a rotating disc for supporting substantially the entire bottom surface of a stack of sheets which are retained within a magazine disposed above the disc. This magazine has one corner pointing oppositely to the direction of rotation of the disc. The disc is provided with a recess, extending radially from the periphery of the disc, and a second recess extending in the direction of rotation from the first recess and covering an angle of rotation of about 90°. The separation apparatus is further provided with a suction element which is adapted to be moved through the recesses in the disc to the corner of the stack of sheets in synchronism with the rotating recesses. This suction element grips and pulls the corner of the bottom sheet through the recesses which allows the rotating disc to slip between the bottom sheet and remainder. The suction element then transports the sheet to a table below the disc where a clamp lever grips the corner of the sheet, before it is released by the suction element. The clamp lever holds the sheet on the table during the remainder of the separation operation. According to another embodiment of the present invention, the disc is provided with two recesses extending radially and two recesses extending in the direction of rotation, in a diametrical arrangement. This allows a faster separation rate.

The high delivery rates and operational reliability of the separating apparatus according to the present invention are due essentially to separation by the pulling down of the corner of the sheet and the transfer of the separated sheet to the support table in a manner which avoids the free falling of the sheets. The gap formed between the two bottom sheets when the suction element pulls the corner down permits the admission of air and allows a high-speed separation operation thus preventing a suction plate effect and the drawing-off of two sheets.

The advantage of providing the first recess with a recess extending in the direction of rotation allows the bottom sheet to be pulled down early while the disc is sliding between the previously separated sheet, because the sucker can be brought up to the next sheet through the recesses while the disc is rotating.

The use of the clamp lever further enhances the separating ability of the present invention by gripping the sheet while the disc is sliding between the sheet and the remainder of the stack and allowing the suction element to engage the last sheet.

Despite the high rate of separation, sufficient time is available for the individual operations, such as applying suction and drawing off. The combined use of the suction element and the clamp lever allows the disc to be provided with diametrically disposed recesses and thus allows two products to be drawn off for each revolution of the disc.

BRIEF DESCRIPTION OF THE DRAWINGS

The present invention may be better understood and its numerous advantages and objects will become apparent to those skilled in the art by reference to the accompanying drawings wherein like reference numerals refer to like elements in the several figures and in which.

DESCRIPTION OF THE PREFERRED EMBODIMENT

Figure 1:
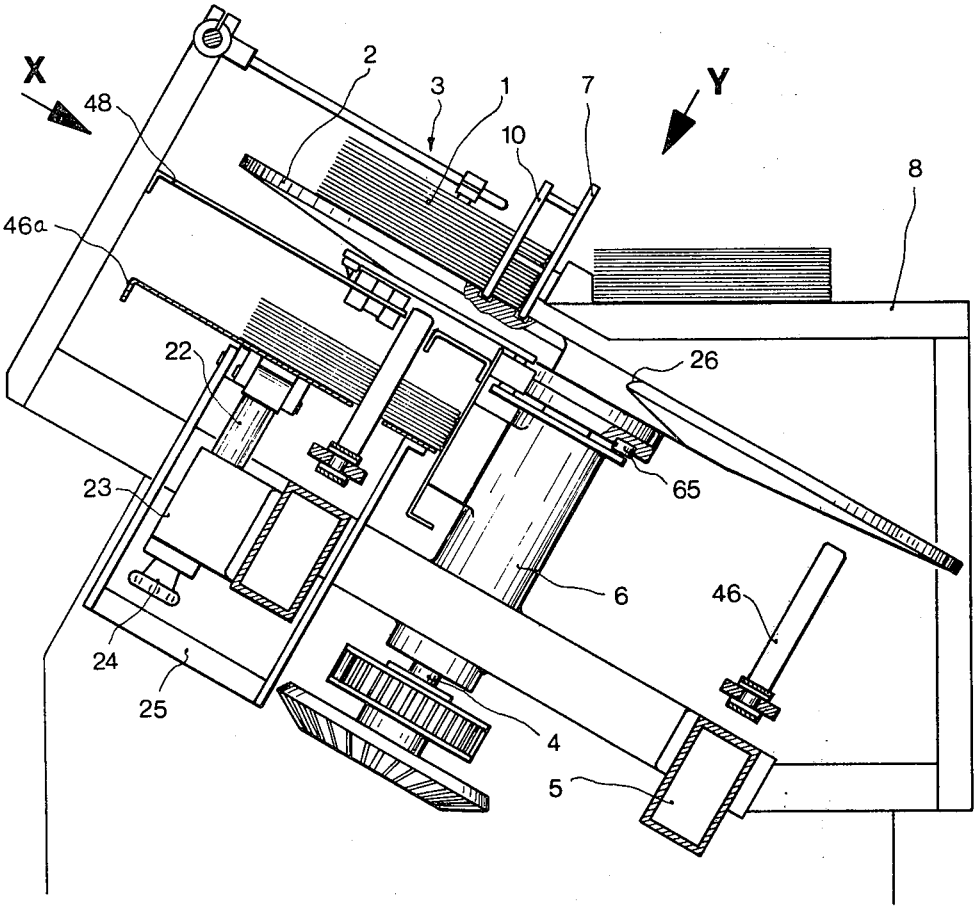
FIG. 1 is a side elevation view of apparatus in accordance with a first embodiment of the present invention.
Figure 2:
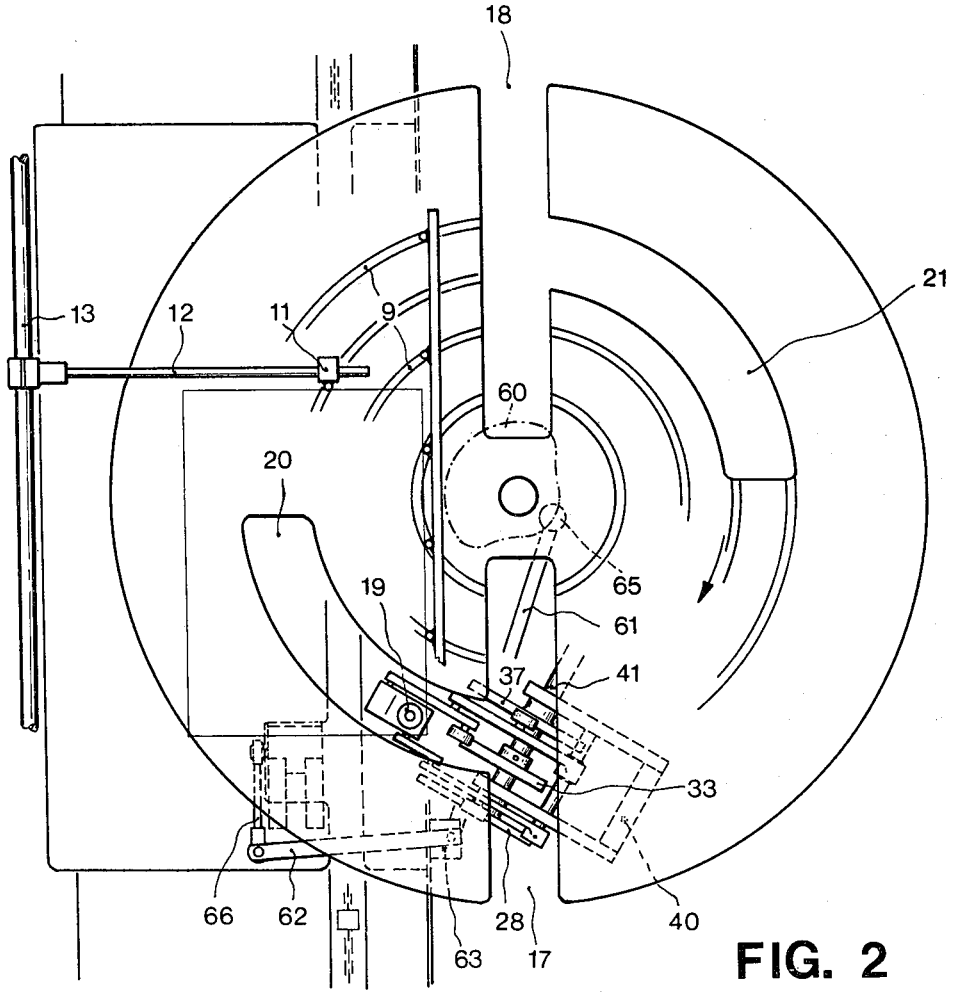
FIG. 2 is a plan view of the apparatus in the direction of the arrow "Y" in FIG. 1.

Referring to FIGS. 1 and 2 jointly a separating apparatus in accordance with the present invention is seen. A stack 1 of book sections which are to be separated is contained in a magazine 3 above a disc 2. Disc 2 is rotationally driven in the direction of the arrow shown in FIG. 2 and forms the bottom boundary of the magazine 3. As the bottom boundary of magazine 3 disc 2 carries the stack of book sections. The magazine 3 is positioned above disc 2 so that the maximum bottom surface of stack 1 is substantially supported by disc 2. Magazine 3 is also positioned so that it has one corner pointing oppositely to the direction of rotation of disc 2.

The disc 2 is rotated by a drive shaft 4 which it is mounted on. Drive shaft 4 is carried within a bearing bush 6 which is bolted to the machine frame 5. The end of drive shaft 4 opposite disc 2 is provided with an arrangement of drive wheels which are rotated by a main drive (not shown).

As shown in FIG. 1 disc 2, which forms the bottom boundary of the magazine 3, is inclined at an angle of approximately 30° in order to align the backs of the sections of stack 1 against a stationary lower end magazine boundary 7. Bottom stationary magazine boundary 7 consists essentially of individual rods which are held in position and secured to a prestacking table 8.

Like the bottom stationary magazine boundary 7, a rear stationary magazine boundary 10 (viewed in the direction of movement) of the magazine 3 is stationary and is joined to and secured in position by magazine boundary 7.

For different size ranges of book sections of stack 1 the magazine 3 has an adjustable front stop 11. Stop 11 is in the form of a bar and is displaceably carried on an arm 12. The arm 12 is likewise carried on a tube 13 which is secured to the machine frame of the separating apparatus. The bottom book section of stack 1 is prevented from being pushed under the magazine boundaries 7 and 10 and stop 11 by projecting ends of boundaries 7 and 10 and the end of stop 11 into the concentric grooves 9 of the disc 2. As stop 11 is moved along arm 12 its end must be positioned into the appropriate groove 9 to assure the bottom book section of stack 1 is not pushed underneath. Magazine 3, as comprised by its individual parts retains the stack 1 in position while disc 2 is being rotated beneath it.

The height of the stack 1 can also be considerably varied. In order to accommodate varying heights of stack 2 the disc 2 is provided in the form of an air table (not shown). Thus reduces friction between the support and the bottom book section.

As FIG. 2 of the apparatus shows, for the purpose of doubling the output of sections separated from stack 1, disc 3 is provided with two diametrically disposed radial slots 17 and 18. These slots 17 and 18 are positioned so that a corner of a book section of stack 1 may be separated from the remainder of the stack, and pulled into the range of action of the disc 2 by a suctioning device discussed below. This enables the rotating disc 2 to penetrate between the separated book sections and the remainder of the book sections and peel off this separated section from the remainder of the stack.

Referring to FIGS. 4*a* to 4*d* a suction device is clearly shown. The suction device contains a sucker 19 and is situated under the disc 2. The suction device moves sucker 19 to-and-fro through slots 17 and 18 of the disc 2 to engage the corner of the bottom section of stack 1. This movement of sucker 19 is in synchronism with the rotating disc 2.

In order to enable the sucker 19 to be properly positioned under the bottom book section at an early stage, so as to allow the sucker 19 to engage the bottom section and pull it through either slot 17 or 18 before disc 2 penetrates the stack 1, the slots 17 and 18 are provided with annular apertures 20 and 21, respectively. These apertures 20 and 21 extend from the slots 17 and 18 and have a length reaching over an angle of rotation of 90°.

The pulling a corner of the bottom section through a slot 17 or 18, by the suction device prevents the so-called "suction plate effect" during the high-speed peeling-off of the bottom section of stack 1 by the separating apparatus. This prevents the peeling off of two sections by the separating apparatus.

Referring to FIG. 1, front edge 26 of a slot, either 17 or 18 is shown, tapering in the direction of rotation, of the radial slot. This wedge like design of front edge 26 ensures undisturbed penetration between the bottom book section, which has pulled through a radial slot, 17 or 18, and the penultimate bottom book section.

Figure 4A:
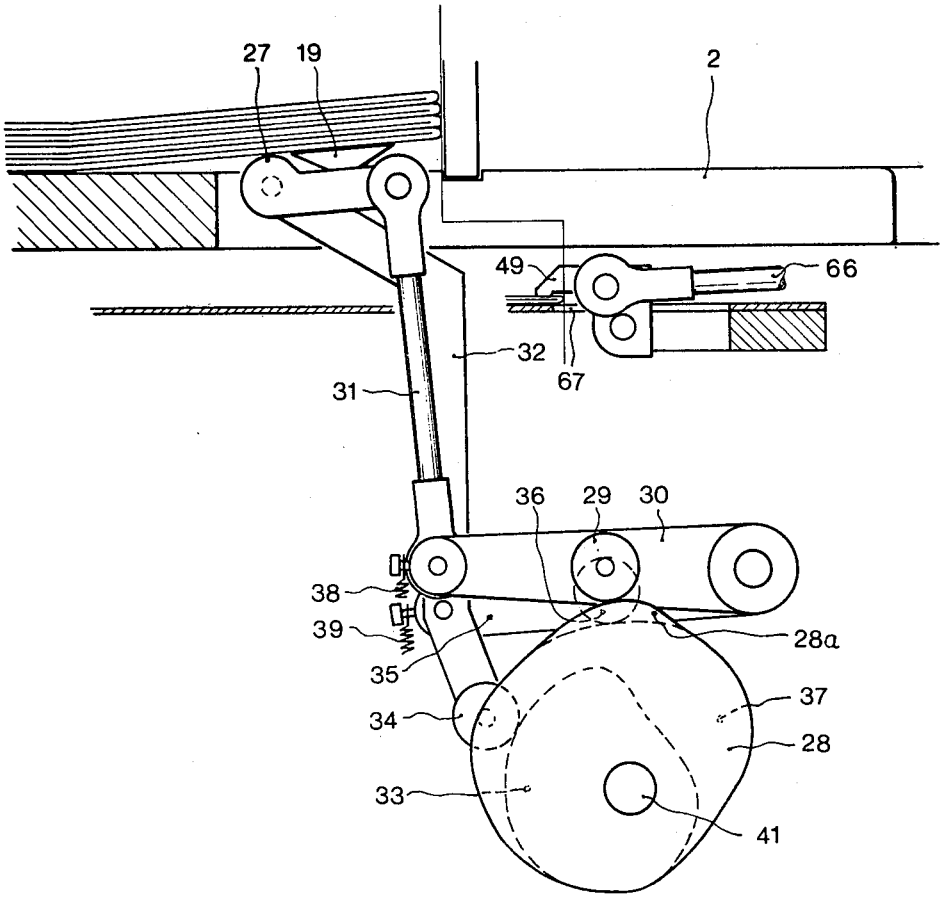
FIGS. 4*a* to 4*d* show schematically the functional cycle in successive phases of movement.
Figure 4B:
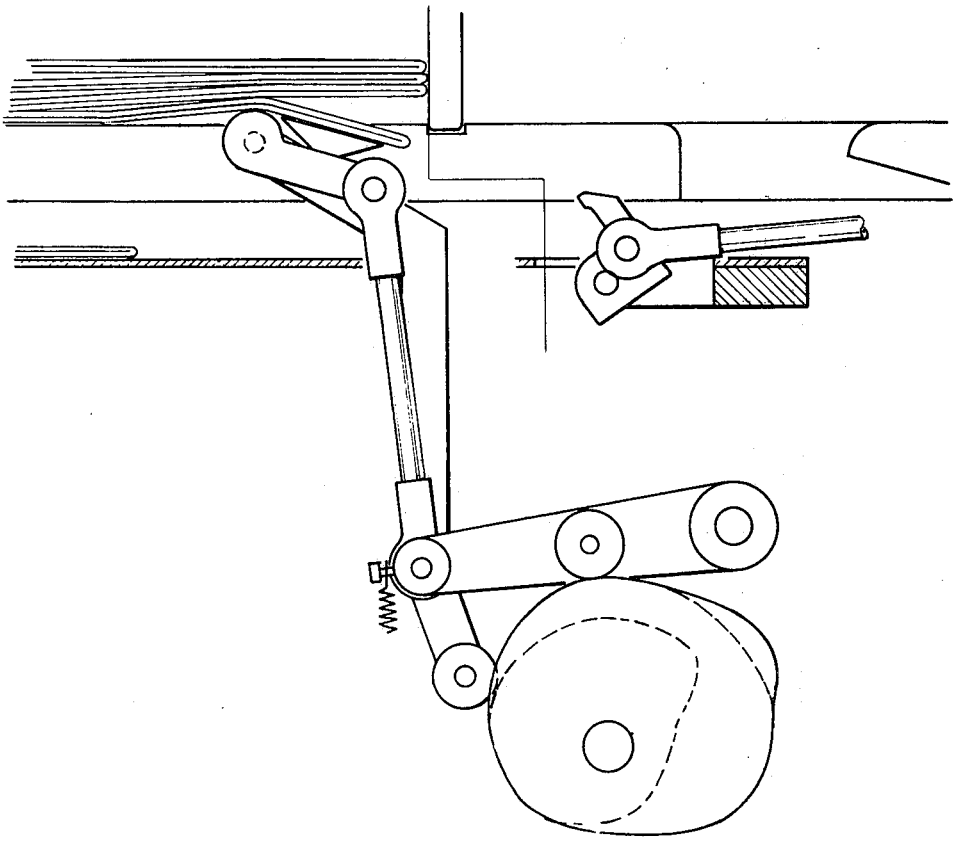
Figure 4C:
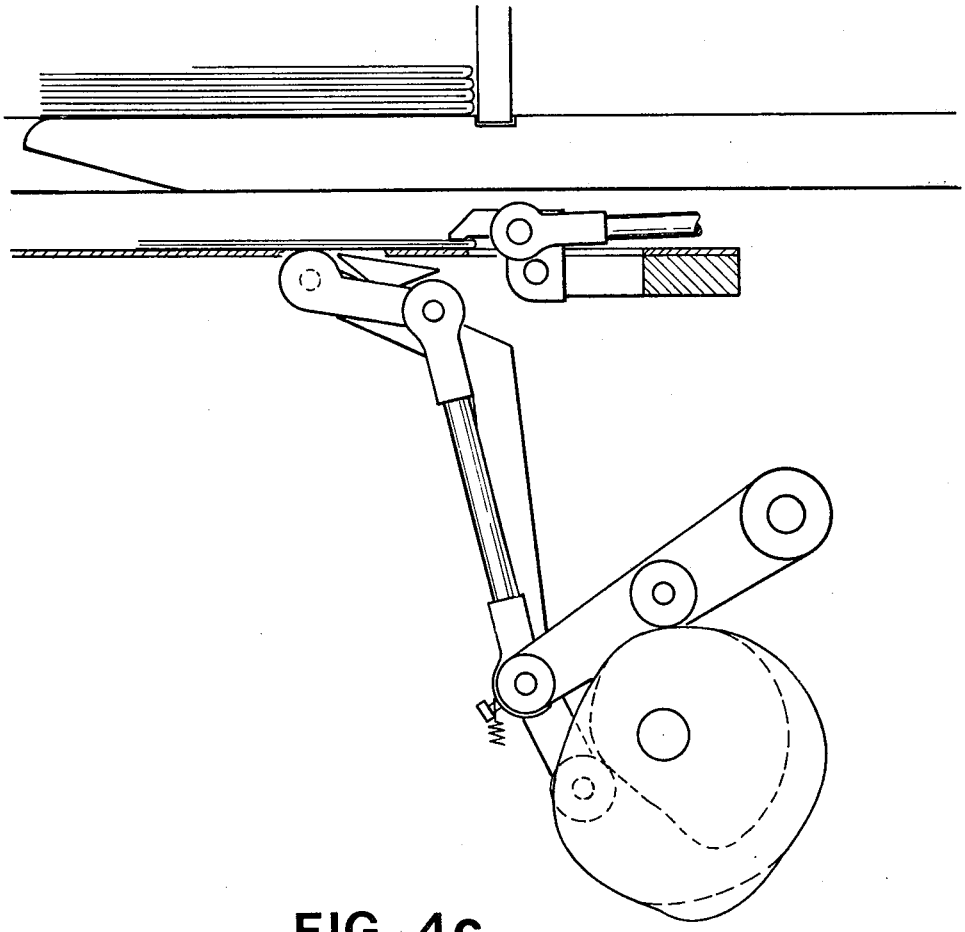

Referring to FIGS. 4*a* through 4*d* the positioning of sucker 19, which is connected to a suction source (not shown), with respect to the bottom section of stack 1 is seen. The suction device is further provided with a stack lifter 27 which forms a unit with the sucker 19 and which passes through a slot, 17 or 18, of the disc 2 to support the stack when the sucker 19 engages the corner of the bottom section. This assures that the bottom book section can be bent over by the stack lifter 27 by the sucker 19 and allow air flow into the gap thus formed, as seen in FIG. 4*b*. The drive for the bending of the bottom section over the stack lifter 27 by the sucker 19 is derived from a rotating cam disc 28. This cam disc 28 is engaged by a follower roller 29 of control lever 30 which is held in contact with cam disc 28 by a tension spring 38. Control lever 30 is rotatably mounted on the machine frame of the separating assembly. The connection between the sucker 19 and the free end of the control lever 30 is made by means of a link 31.

The movement of the stack lifter 27 is controlled by an angle lever 32. Lever 32 is rotably mounted on the free end of the lifter 27 and has mounted on its other end a follower roller 34. Roller 34 engages a cam disc 33. Another control lever 35 is rotatably mounted on the machine frame and is rotatably mounted to the angle lever 32. Lever 35 is provided with a central follower roller 36, which is held by a tension spring 39 against a cam disc 37.

All of the above mentioned cam disc are disposed drivingly on a common drive shaft 41 mounted in a U-shaped structural part 40 bolted to the frame as seen in FIG. 2.

Reference is made again to FIGS. 4*a*–4*d* which illustrate the movement of the suction device. The stack lifter 27 and the sucker 19 are moved through almost identical motions by the control cams 28 and 37. However, the sucker 19 makes an additional movement, while the stack lifter remains stationary, through the action of the control cam extension 28*a* of the cam disc 28. This additional movement of sucker 19 is made about the axis of rotation of the angle lever 32. The sucker 19 first moves upwards in order to apply suction reliably to the bottom book section. The sucker 19 is then moved about 15° downwards in order to bend the bottom book section over lifter 27. The stack lifter 27 and sucker 19 are now moved jointly through the remainder of the separation process.

When the separating apparatus is processing normal book sections sucker 19 is comprised of a rubber sucker. When materials which are permeable are being separated, compressed air suckers working on the hydrodynamic paradox principle are used. Instead of suction being applied, the suckers 19 are fed with compressed air. The remainder of apparatus controls remain unchanged.

For the processing of single sheets, a separating knife (not shown) adapted to be swung between the individual sheets may be installed directly above the plane of the disc 2. This further aids the supporting action of the stack lifter 27 and prevents the stack from sagging at the corner which is pulled down. This allows the disc 2 to be reliably inserted between the sheet bent over the lifter 27.

Figure 3:
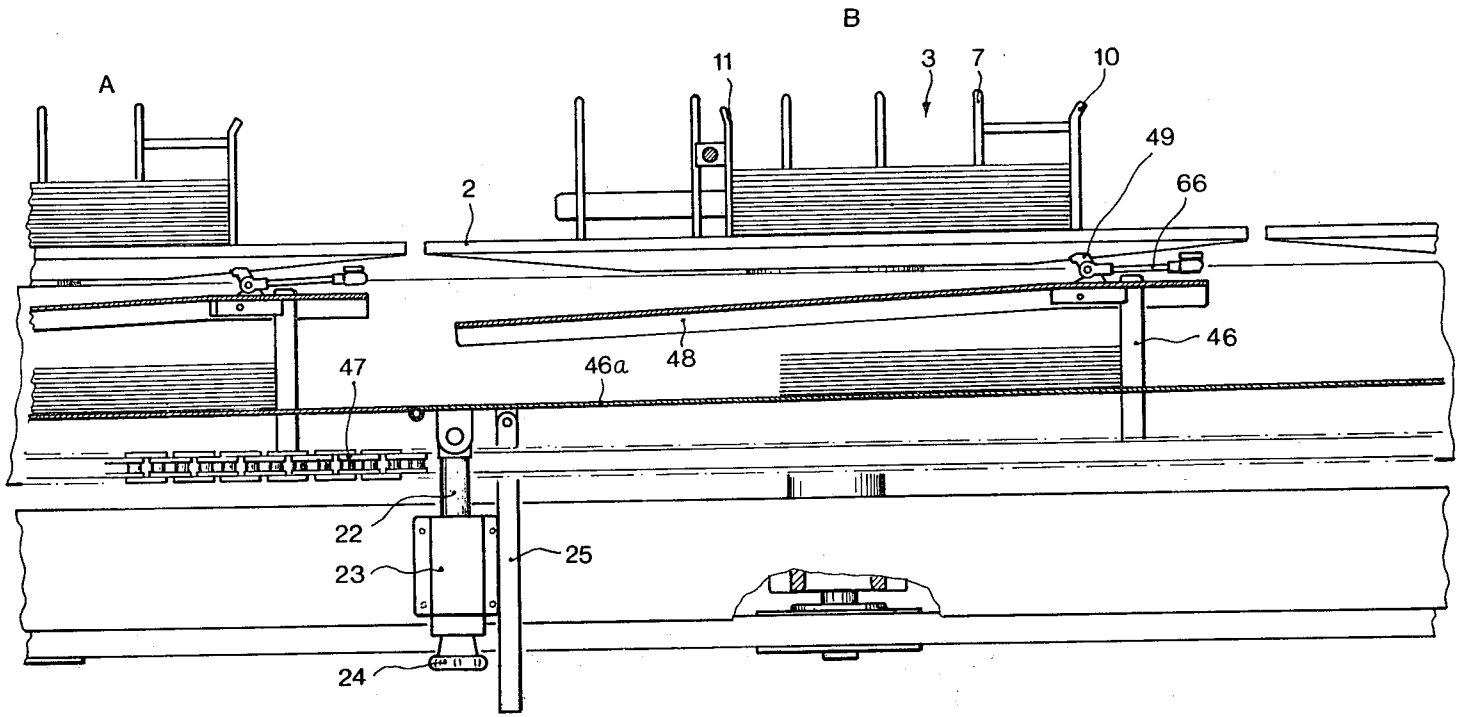
FIG. 3 is a front view, in the direction of the arrow "X" in FIG. 1, of two apparatii in accordance with the invention as they are arranged in a collating machine.

FIGS. 3 and 1 show a section of a collating machine for book sections, in which use is made of two serially disposed separating apparatuses A and B in accordance with the present invention. The book sections are brought down in succession after being separated by the separating apparatuses A and B by any known manner. One such method involves using drivers 46 which are rotated by a rotating conveyor chain 47 which bring the sections down from inclined intermediate tables 48. Tables 48 are installed below the disc 2 with the separated book sections being first deposited on them. The book sections are then transferred to the stack of book sections on a conveyor table 46*a* by the drivers 46.

In order to keep as low as possible the height from which the separated book sections fall from the intermediate table 48 to the stack of book sections on conveyor table 46*a*, the height of the conveyor table 46*a* can be adjusted. Conveyor table 46*a* is adjusted by adjusting elements 22 to 25. The conveyor table 46*a* is adjusted to allow enough clearance for the thickness of the collated stack of book sections. The conveyor table 48 is preferably comprised of individual table segments—for example one segment for every three separating apparatuses. These segments are articulated to one another and are individually adjustable in height.

In the separation and collating process described above a book section, which has been engaged by the sucker 19 and is separated from the stack of book sections, is pulled down by the sucker 19 onto the intermediate table 48. Before the suction to sucker 19 is cut off, the section is gripped by a clamp lever 49 on the intermediate table 48. Clamp lever 49 retains the section until the driver 46 of the conveyor chain 47 starts to drive the book section and deposit it upon conveyor table 46*a*.

With reference jointly to FIGS. 1, 2, 4*a* and 5 the opening and closing of the clamp lever 49 will be explained. Clamp lever 49 is rotatably mounted within a recess 67 of the table 48. The movement of lever 49 is controlled by a cam disc 60 which is mounted around the drive shaft 4 of the disc 2. The cam disc 60 is engaged by a follower roller 65 which is rotatably connected to a link 61. Link 61 is interconnected with link 62 and swivels about a center of rotation 63, as follower roller 65 rolls in a cam disc 60. Clamp lever 49 is connected to this arrangement by rod 66 which is pivotally connected to the free end of rod 62.

Figure 4D:
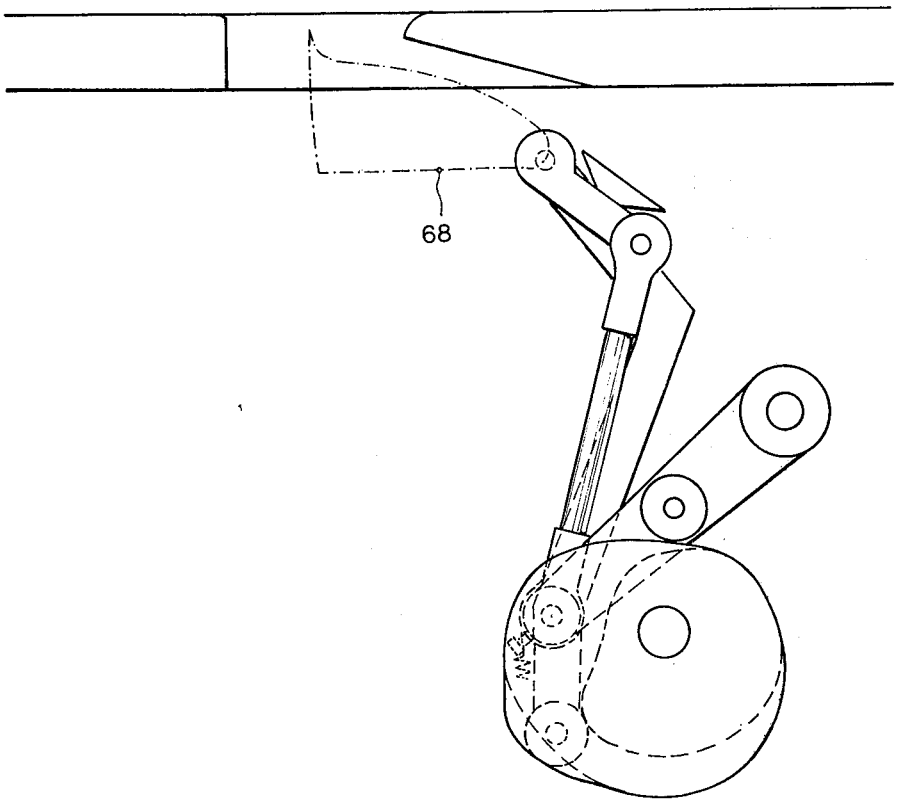

In FIG. 4*d* the path of movement of the sucker 19 is seen as pathway 68. As already mentioned, during the transfer of the book section, from the sucker 19 to the intermediate table 48 clamp lever 49 grips the book section and prevents an uncontrolled free fall. While the clamp lever 49 is holding the book section in the second phase of movement of the separation operation, the suctioning device disengages the book section and is lowered beneath disc 2, following the orbit 68. The suctioning device is then raised up through the slot, 17 or 18, in the disc 2, and sucker 19 engages and pulls down the next book section.

Figure 5:
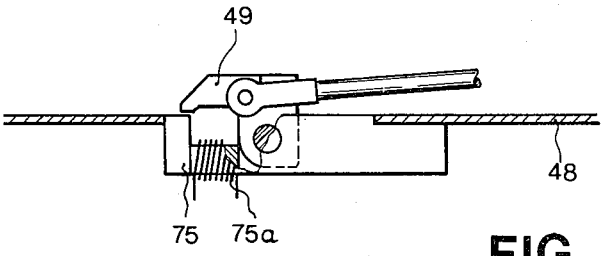
FIG. 5 shows a fault and double sheet detection device on the intermediate table of the separating apparatus.

Referring to FIG. 5 a faulty and double sheet detecting device on the intermediate table 48 is seen associated with lever 49. The detecting device incorporates a magnetic circuit which is comprised of an armature 75, having its support surface lying at the level of the intermediate table, and clamp lever 49 which functions as the yoke. Positioned between armature 75 and lever 49 is a biased coil 75*a* which forces lever 49 away from armature 75. The distance between lever 49 and armature 75 is then measured inductively in accordance with the thickness of the book sections. The output voltage of the inductive measuring system, which is adjusted with the aid of a potentiometer, is compared with two set values. The first value is set at the minimum thickness of the book sections while the second value is set between the thickness of one or two book sections. If the first value is not exceeded during the clamping of the book section, a "faulty sheet" signal is transmitted and if the value is exceeded a "double sheet" is signalled.

While the preferred embodiment has been described and illustated, various modifications and substitutions may be made thereto without departing from the spirit and scope of the invention. Accordingly, the present invention has been described by way of illustration and not limitation.

I claim:

1. Apparatus for separating single sheets from a stack of sheets by removing one sheet at a time from the bottom of the stack, the apparatus comprising:

rotating disc means, said disc means rotating in one direction, said disc means having an upper surface upon which substantially the entire surface of the lower sheet of a stack of sheets will be supported, said disc means being provided with at least a first linear aperture defined by a pair of straight substantially parallel edges, said first aperture extending radially inwardly from the periphery of said disc means, said first aperture having sufficient length and width to allow the passage therethrough of a sheet from the stack, said disc means being further provided with at least a second aperture, said second aperture having an arcuate shape and extending from said first aperture leading edge intermediate the ends of said first aperture in the direction of disc means rotation;

stack retaining means, said stack retaining means being positioned above said upper surface of said disc means, said retaining means being stationary and positioning a stack of sheets upon said upper surface of said disc means while said disc means rotates beneath the stack, said retaining means positioning the stack upon said upper surface of said disc means so that one corner of the stack faces generally oppositely to the direction of rotation of said disc means whereby said corner will be intercepted by the straight trailing edge of said pair of first aperture defining edges;

fluidic separator means, said separator means being located beneath said disc means, said separator means being in part movable through said second aperture to cooperate with a sheet which is at the bottom of the stack in the region of said one corner, said separator means including means for establishing a pneumatic force which causes said one corner to be deflected downwardly through said first aperture during movement of said separator means to thereby provide a space between the bottom sheet and the remainder of the stack whereby the bottom sheet will be separated from the stack by the rotational movement of said disc means and passed through said first aperture;

separator control means, said control means moving said separator means through said second aperture, said control means synchronizing the movements of said separator means with the rotation of said disc means to prevent said separator means from contacting said disc means; and means for guiding sheets separated from the stack by said separator means, said guiding means including table means and movable clamp lever means, means for causing movements of said clamp lever means, said clamp lever means temporarily holding individual sheets against said table means, said movements of said clamp lever means being synchronized with the movements of said separator means whereby a separated sheet will be clamped to said table means for a period of time beginning prior to termination of cooperation between the separator means and the sheet.

2. The apparatus of claim 1 wherein said separator means further comprises:

stack lifting means, said lifting means being synchronized with said force establishing means to raise the stack upwardly prior to said bottom sheet one corner being deflected downwardly whereby said bottom sheet will be caused to pass under said disc means for engagement by said guiding means clamp lever means while the remainder of the stack will be raised above said first aperture.

3. The apparatus of claim 2 wherein said first aperture trailing edge is wedge shaped.

4. The apparatus of claim 3 where said control means synchronizes the movement of said force establishing means and said lifting means to prevent engagement between the stack and said first aperture wedge-like edge.

5. The apparatus of claim 4 further comprising:

multiple sheet detection means, said detection means measuring the thickness of the sheet material held on said table means by said lever means to determine if more or less than a single sheet has been withdrawn from the stack.

6. The apparatus of claim 2 wherein said force establishing means and said lifting means define a unitary structure and wherein said control means imparts orbital motion to said unitary structure.

7. The apparatus of claim 6 wherein said force establishing means is moveable upwardly and downwardly relative to said lifting means.

8. The apparatus of claim 1 wherein said second aperture extends from said first aperture for a distance covering a angle of rotation of approximately 90°.

9. The apparatus of claim 8 wherein said separator means further comprises:

stack lifting means, said lifting means being synchronized with said force establishing means to raise the stack upwardly prior to said bottom sheet one corner being deflected downwardly whereby said bottom sheet will be caused to pass under said disc means while the remainder of the stack will be raised above said first aperture.

10. The apparatus of claim 1 further comprising:

collating means for arranging sheets separated from the stack into groups, said collating means being positioned beneath said disc means; and means for transmitting separated sheets from said separator means to said collating means.

11. The apparatus of claim 1 wherein said disc means includes at least two pairs of said cooperating first and second apertures and a separator means associated with each pair of apertures.

12. The apparatus of claim 11 wherein said disc means is arranged so that its upper surface is at an oblique angle with respect to the horizontal.

13. The apparatus of claim 12 wherein said separator means each further comprises:

stack lifting means, said lifting means being synchronized with said force establishing means to raise the stack upwardly prior to said bottom sheet one corner being deflected downwardly whereby said bottom sheet will be caused to pass under said disc means while the remainder of the stack will be raised above said first aperture.

14. The apparatus of claim 13 wherein said force establishing means and said lifting means define a unitary structure and wherein said control means imparts orbital motion to said unitary structure.

15. The apparatus of claim 14 wherein said force establishing means is moveable upwardly and downwardly relative to said lifting means.

* * * * *